United States Patent [19]

Westphal et al.

[11] Patent Number: 4,917,416

[45] Date of Patent: Apr. 17, 1990

[54] WINDOW LATCHING DEVICE

[75] Inventors: Dennis Westphal, Galva; Jonathan Piles, McPherson, both of Kans.

[73] Assignee: CertainTeed Corporation, Valley Forge, Pa.

[21] Appl. No.: 247,157

[22] Filed: Sep. 21, 1988

[51] Int. Cl.[4] ..... E05C 1/10

[52] U.S. Cl. ..... 292/175; 292/DIG. 4; 292/DIG. 47

[58] Field of Search ..... 292/DIG. 47, DIG. 4, 292/163, 175, DIG. 15; 49/450, 467

[56] References Cited

U.S. PATENT DOCUMENTS

| | | | |
|---|---|---|---|
| D. 222,994 | 2/1972 | Dallaire | D13/6 |
| D. 285,610 | 9/1986 | Slocomb, Jr. | D25/74 |
| D. 286,186 | 10/1986 | Bancroft | D25/74 |
| 603,597 | 5/1898 | Kittelsen et al. . | |
| 688,491 | 12/1901 | Sigler | 292/204 |
| 756,453 | 4/1904 | Arens et al. | 292/163 |
| 833,900 | 10/1906 | Sigler | 292/163 |
| 881,658 | 3/1908 | Bowman | 292/204 |
| 4,144,674 | 3/1979 | Dovman | 49/417 |
| 4,578,903 | 4/1986 | Simpson | 49/175 |
| 4,655,489 | 4/1987 | Bisbing | 292/DIG. 4 X |
| 4,702,506 | 10/1987 | Iimura | 292/DIG. 4 X |

*Primary Examiner*—Richard E. Moore

*Attorney, Agent, or Firm*—Paul & Paul

[57] ABSTRACT

A device to allow the secured, partial opening of double-hung windows is disclosed. The latch has an insert shell that is fixed into a vertical frame and a spring-loaded plug that is set to an open or closed position.

7 Claims, 3 Drawing Sheets

WINDOW LATCHING DEVICE

BACKGROUND OF THE INVENTION

The instant invention relates to latching devices in general, and more particularly, to latching devices that are used with two or more pieces that are in sliding engagement with one another.

The window latching device provides an intermediate position security latch that can be used with, among others, double-hung windows, where there is a master window frame that holds an upper and a lower sash in adjacent and sliding relations and the device can be retro-fitted into the window or it can be built in as original equipment. Windows of this type are shown in U.S. Pat. No. 4,578,903 to H. Simpson and U.S. Pat. No. 4,144,674 to N. Dovman.

In some cases, it is desirable to be able to allow either the top sash or bottom sash to remain open for a space, but yet still maintain the window in a secure mode that will prevent unauthorized entry. Some modern windows are made with an arrangement that consists of a dead-bolt and multiple pre-drilled holes, and this will allow the window to be opened to limits predetermined by the position of those holes. Unfortunately, this arrangement has no flexibility to have greater or lesser amounts of opening. In addition, there are many windows, made without the above-described arrangement, that have no intermediate security provision and must be guarded when they are opened.

SUMMARY OF THE INVENTION

A window latching device for use in double-hung windows to provide variable opening positions therefore is disclosed. The device comprises an insert shell for setting into the inner face of a vertical frame of the outermost one-half of a window and having a hollow interior for receiving a latching plug. The latching plug is biased from a closed and flush-mounted position to an open and protruding position and is controlled in reciprocal movement from one extreme to the other by the combination of springs forcing the plug away from the shell and an internal catch pin which is fixed at one end to the shell and sequentially moved through a series of retainer steps in the plug.

OBJECTS OF THE INVENTION

It is therefore an object of the present invention to provide a window latching device that will provide a securable, intermediate opening latch for double-hung windows.

It is a further object of the invention to provide a window latching device that can be installed on a double-hung window or retro-fitted thereto.

It is still further object of the present invention to provide a window latching device that may be easily retro-fitted to existing windows to give a plurality of intermediate opening positions. These and other objects and advantages of the present invention will be readily apparent to those skilled in the art by reading the following Description of the Preferred Embodiment and the appended claims.

DETAILED DESCRIPTION OF THE PREFERRED EMBODIMENT

The latching device of the present invention is shown as it can be used in a double-hung window, as shown in window assembly 13, in FIG. 1, and dotted lines are drawn across the upper part of the window 11 and the lower part of the window 12 for illustration purposes to show that the lower half of the window could be raised to that height when latching device 10 is opened, as will be explained.

Figure 1:
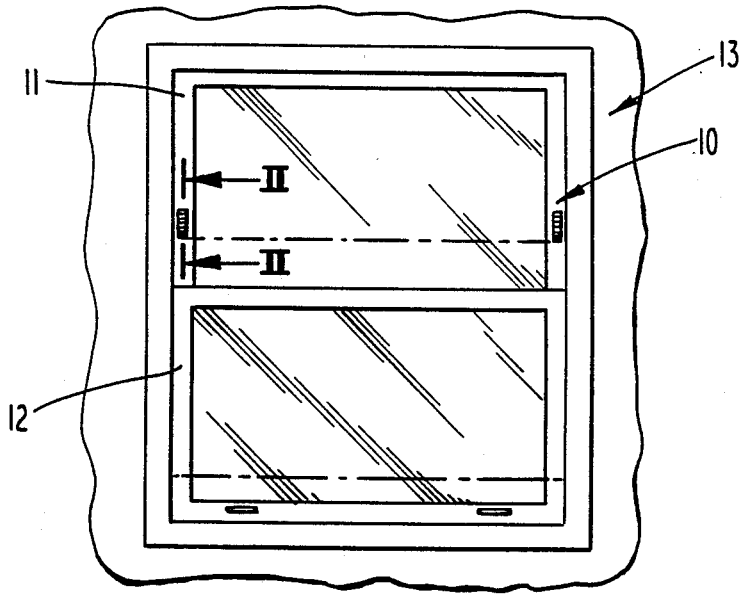
FIG. 1 shows an elevational view of a double-hung window assembly with a window latching device installed on the inner face of a vertical frame of the upper half of the assembly.
Figure 2:
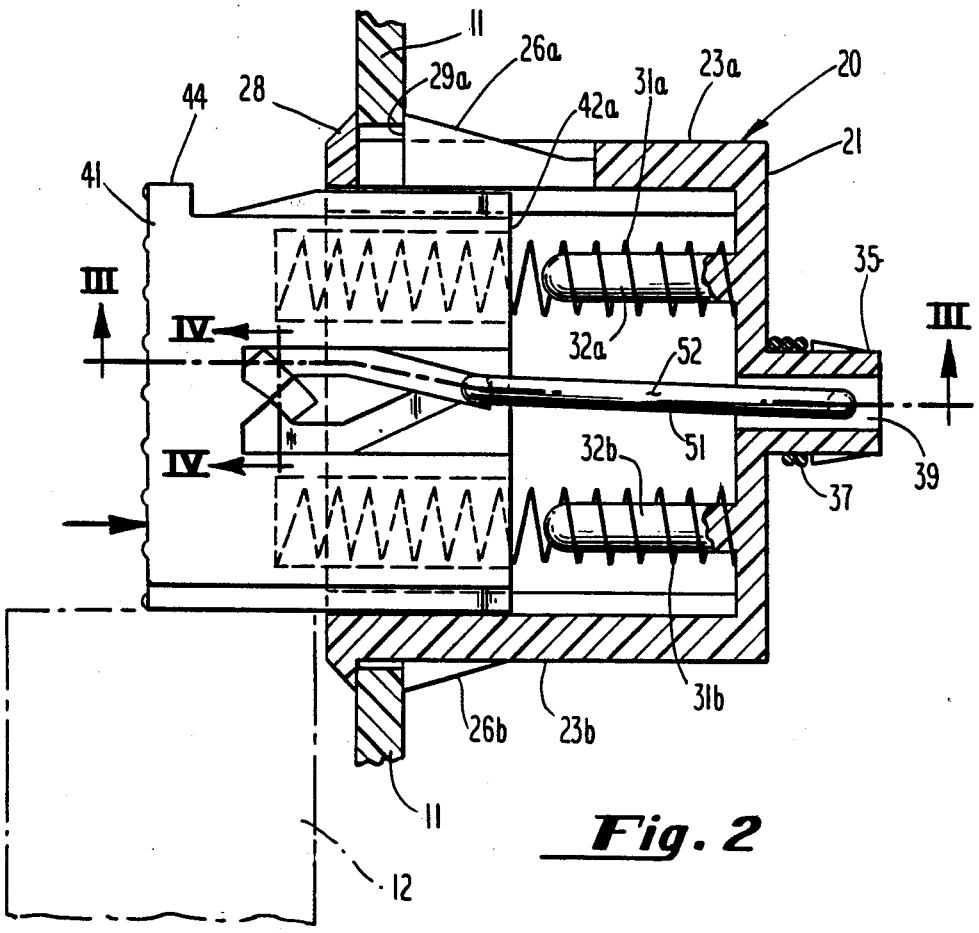
FIG. 2 is a sectional view of the latching device taken along lines II—II of FIG. 1.

FIG. 2 is a sectional view of the latching device 10 taken along lines II—II of FIG. 1 and shows an elevational view of latching device 10 in its open position. Device 10 is in the form of a hollow insert shell 20 that has a backside 21, two parallel sides 23*a*and 23*b*, both connected to the backside 21 and an open face opposite of backside 21. Shell 20 can be made from plastic materials, as is known in the art, and sides 23*a* and 23*b* contain a small pivoting wedge 26*a*, and a non-pivoting wedge 26*b* respectively. Wedge 26*a* is contained therein to first compress, as shell 20 is being pushed into an aperture in the inner face of vertical frame 11 (only partially shown in FIG. 2), and then expand to firmly lock shell 20 into the aperture by capturing the edge of the aperture between a rim 28, which surrounds the open face of shell 20, and the flat sides 29*a*, 29*b* of wedges 26*a*, 26*b*. The thickness of rim 28 around the open face of shell 20 is of a predetermined thickness to be thin enough to not impede the movement of the lower half 12 (shown in phantom in FIG. 2) of the window as it slides past latching device 10 when device 10 is in the closed position. More than one latching device 10 can be used in a window, as for example, two devices 10 are shown in place in FIG. 1.

Inside the interior of shell 20 are biasing means such as extension springs 31*a*, 31*b*. Springs 31*a*, 31*b* are set around anchoring posts 32*a*, 32*b*, respectively, and are normally extended out of the open face of shell 20. A latching plug 41 slidably fits inside the interior of shell 20 and springs 31*a* and 31*b* are captured by corresponding tubular shaped openings 42*a* and 42*b* corresponding to the shape and position of posts 32*a*, 32*b* inside plug 41. Plug 41 is shown in the open position in FIG. 2 since springs 31*a* and 31*b* are forcing it outwardly from inside shell 20. In addition, shell 20 has a small post 35 extending from the middle of back side 21, as will be explained.

Figure 3:
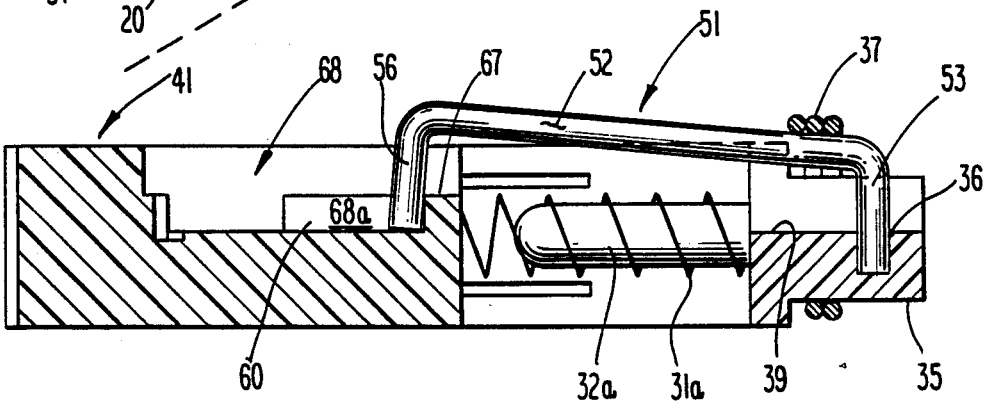
FIG. 3 a sectional view taken along lines III—III of FIG. 2.
Figure 4:
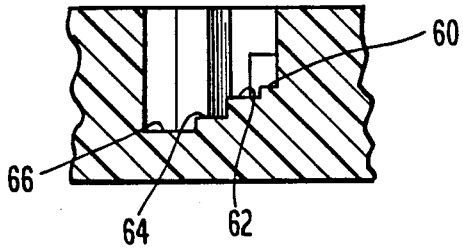
FIG. 4 is a sectional view taken along lines IV—IV of FIG. 2.

Plug 41 is a rectangular shaped, mostly solid, molded piece that conforms to the inside dimensions of shell 20. To aid the sliding movement inside shell 20, plug 41 has a side lip 44 at one side that extends out above the circumference of the top or outer edge thereof and a thin rail-like strip 45 along the opposite side thereof to help guide sliding movement of the plug in shell 20. As can be seen in FIGS. 3 and 4, sectional views along lines III—III and IV—IV respectively, there are a series of steps 60, 62, 64 and 66 cut inside the central portion of plug 41 as will be described.

Figure 5:
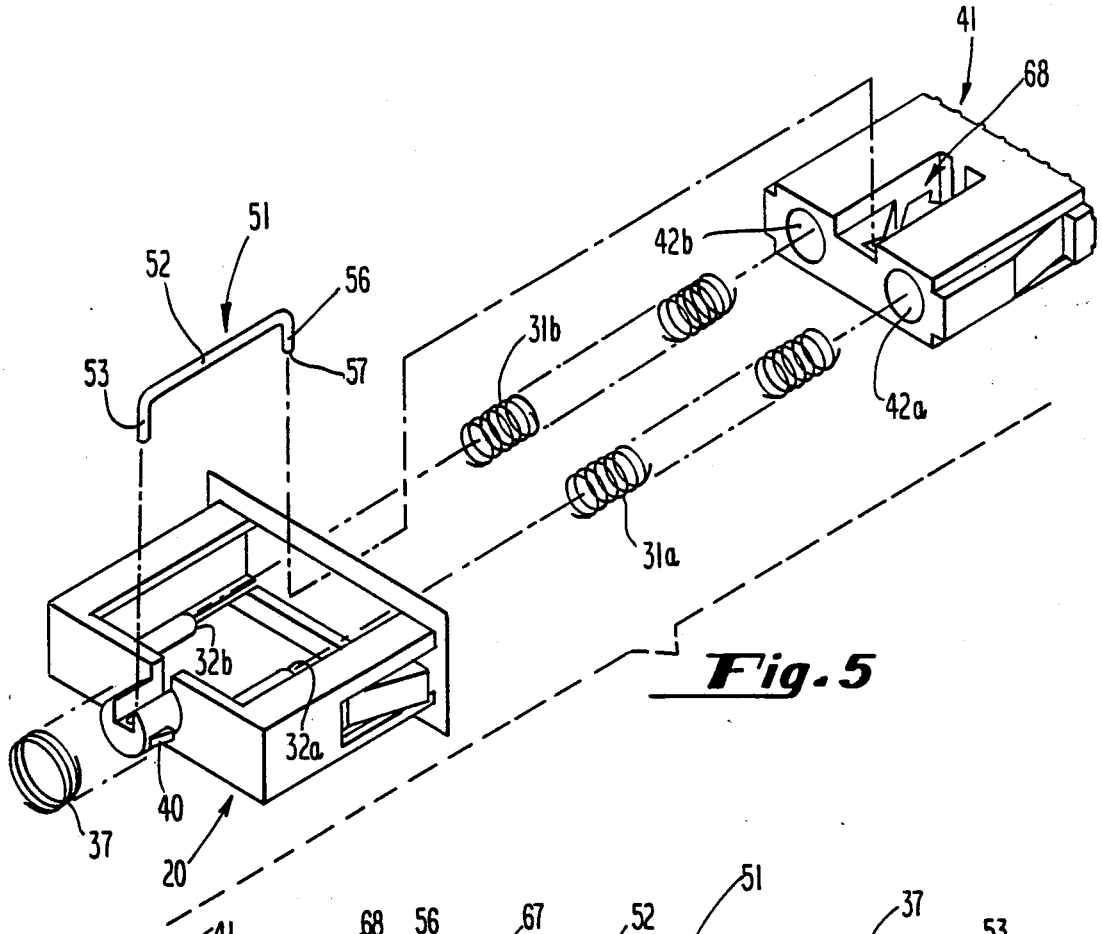
FIG. 5 is an expanded perspective view showing the parts of the instant invention.

As seen more clearly in FIG. 3, Latching device 10 uses a catch pin 51, which is in the form of a widened "U", having two legs and a base, to act on plug 41 and determine positioning of plug 41, either inside or protruding from shell 20. A first leg 53 of pin 51 is set into an aperture 36 in post 35 and a retainer, such as a small spring 37, is wrapped around the base 38 and maintained there by a stop-wedge 40 (see FIG. 5). The underside of the portion of base 52 that is held against post 35 rides inside a groove 39 therein, as can be seen in FIG. 2. Base 52 is of a pre-calculated length and has an opposite leg 56, similar to leg 53, for hooking individual steps in plug 41.

Guiding means, such as steps 60, 62, 64, and 66, as seen in FIGS. 2 and 4, to lead the hooking end 56 of catch pin 51 are built into plug 41 in a centrally located recess 68. Step 60 extends from a centrally located position inside the inner edge wall 67 towards the side wall 68*a* of recess 68 and then therealong for a predetermined distance. Since catch pin 51 is only held by a retainer 37 at post 35 in cantalever fashion, and is formed in the shape, as described above, of a widened "U", it is biased so that the tip end of leg 56 is forced against the surface of step 60 as plug 41 is pushed inwardly into shell 20. When tip 57 reaches the end of step 60, the above-mentioned bias on catch pin 51 forces leg 56 to "step" down a level onto step 62. At this point, plug 41 has been moved against springs 31*a*, 31*b*, inside of shell 20, and therefore out of the way, and when pressure is released, some of the potential energy stored in springs 31*a*, 31*b* forces plug 41 back out to a position flush with the opening in shell 20. Tip 57 now rides across step 62 and down onto step 64 and leg 56 is caught by sidewalls 64*a*, 64*b* (only 64*b* partially shown in FIG. 5). Latching device 10 is now closed and out of the way of the windows being opened.

When a further push is given to plug 41, tip 57 "steps" down again onto a rising step 66, and with a release of plug 41, more of the spring energy sends plug 41 out to an opened and protruding position. In this position, plug 41 will prevent further movement, upwardly, of sash 12 (see FIG. 1). Step 66 runs in the reverse of step 60 and forces tip 57 back out to its centrally-located position adjacent inner edge wall 67. Step 60 is sloped, upwardly, to force catch pin 51 to "step" down, back onto step 60, once it runs off the edge thereof.

Figure 2A:
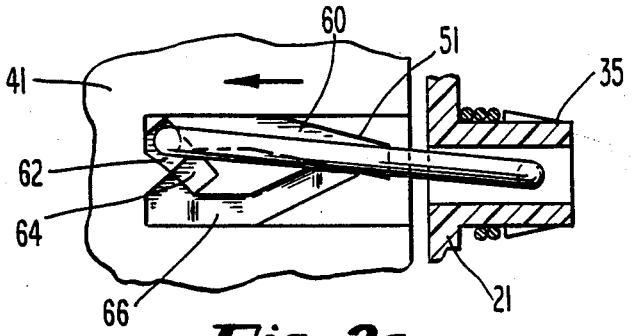
FIGS. 2*a*, 2*b* and 2*c* are schematic representations of the movement of catch pin through the guide steps in the latching plug as the latching device is moved between the closed position and the open position.
Figure 2B:
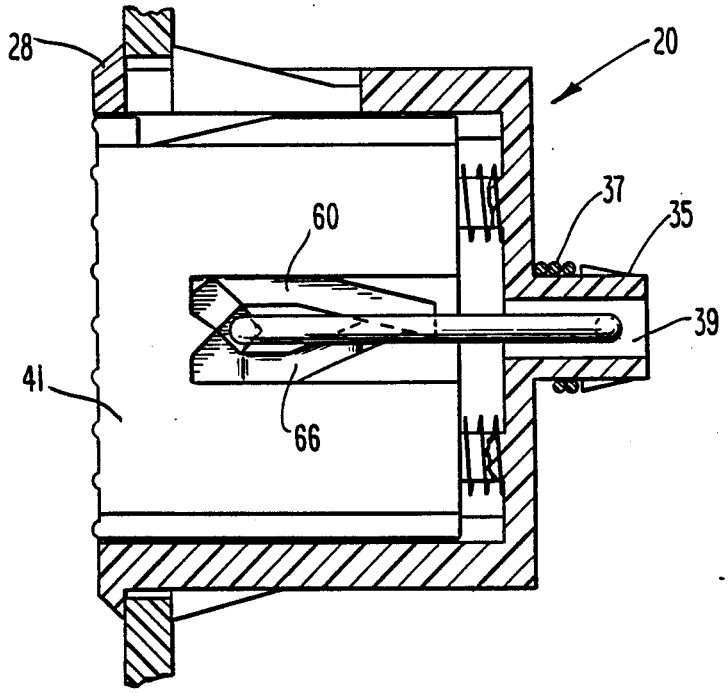
Figure 2C:
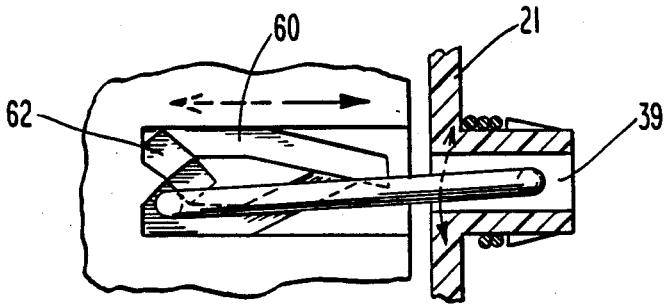

The above-described movements are depicted schematically in FIGS. 2*a*, 2*b* and 2*c*. In FIG. 2*a*, plug 41 has been pushed into shell 20 and catch pin 51 has travelled along the first part of the guiding means, or step 60 (as shown by the directional arrow in FIG. 2*a*) until it reached step 62. At this point, plug 41 has reached the limit of its slide inside shell 20 and when it is now released, will back out a small distance until leg 56 hooks into step 62, as seen in FIG. 2*b*. Latching device 10 is now closed and in a flush position with the inner face of vertical frame member on the inside of sash 12. When it is ready to open latching device 10, a slight push on plug 41 is needed to transfer leg 56 onto step 66, as seen in FIG. 2*c*, so that it can travel back to hook onto the inner edge wall 67 (as shown by the dotted and full arrows in FIG. 2*c*). Latching device 10 is now in its open and protruding position to prevent sash 12 from sliding any further than where a device 10 is positioned.

Obviously, many modifications and variations of the present invention are possible in light of the above teachings, and, it is therefore understood that, within the scope of the disclosed inventive concept, the invention may be practiced otherwise than specifically described.

What we claim is:

1. A window latching device for use in double-hung windows to allow variable latched open spaces between individual sashes thereof comprising:

an insert shell fixedly set into an aperture in the inner face of a vertical member of a first window sash, said shell being hollow with an outwardly facing opening therein for receiving a latching plug;

a latching plug with an inner edge and an oppositelydisposed outer edge slidably mounted for movement therein in said shell; and control means connected between said shell and said plug to bias movement of said plug between a flush-mounted window opening position and a protruding partial opening position, said control means including at least one spring mounted between the inside of said shell and said plug and a catch pin fixed to the interior of said shell in a cantilever manner at one end and having hooking means at the opposite end thereof, and guiding means in said plug for leading said hooking means to predetermined hooks.

2. A device as in claim 1 wherein said guiding means comprises a plurality of steps leading from adjacent the inner edge of said plug.

3. A device as in claim 2 wherein said hooking means is the opposite end of the pin formed to a corner of substantially 90 degrees.

4. A window latching device for use in double-hung windows, comprising:

an insert shell having an open front end, a back end opposite therefrom and parallel sides connecting said ends for fixedly inserting into a predetermined aperture in the inner face of a vertical member of a window sash;

a latching plug having a front side and a back side and being slidably mounted in said shell to move from an opened position to a closed position and having guiding steps therein;

at least one extension spring mounted between the inside of back end of said shell and said plug; and a catch pin fixed at one end to the back end of said shell and having a hook at the opposite end for sequentially moving through said steps as said plug is moved from the opened position to the closed position.

5. A window and frame assembly comprising:

a pair of windows slidably mounted adjacent one another so that the outside surface of one window is adjacent the inner surface of the second window;

an insert shell fixedly set into an aperture in the inner face of a vertical member of the second window, said shell being hollow with an opening adjacent the inner face;

a latching plug with an inner edge and an oppositelydisposed outer edge slidably mounted in said shell for movement therein; and control means connected between said shell and said plug to bias movement of said plug between a flush-mounted window opening position and a protruding window sash stop position partially out of said shell said control means including at least one spring mounted between the inside of said shell and said plug and a catch pin fixed to the interior of said shell in a cantilever manner at one end and having hooking means at the opposite end thereof, and guiding means in said plug for leading said hooking means to predetermined hooks.

6. An assembly as described in claim 5 wherein said guiding means comprises a plurality of steps leading from adjacent the inner edge of said plug.

7. A latching device that is inserted in an inner, vertical member of the outward most sash of double-hung windows in position that will prevent the inner-most sash from moving beyond said position relative to the other sash, comprising:

an insert shell for fixedly setting into an aperture in the inner face of a vertical member of a first window sash, said shell being hollow with an outwardly facing opening therein;

a latching plug with an inner edge to be disposed inside said shell and an oppositely disposed outer edge, said plug mounted for sliding movement into and out of said shell;

at least one compression spring between the inside rearwardmost surface of said shell and said plug;

at least one catch pin fixed at a first end in a cantilever manner from the rearward-most surface of said shell and projecting onto one of a series of surfaces adjacent the inner edge of said plug.

* * * * *